US005104089A

United States Patent [19]

Shook et al.

[11] Patent Number: 5,104,089

[45] Date of Patent: Apr. 14, 1992

[54] CONCRETE POURING FORM SYSTEM FOR BRIDGE OVERHANG DECKS

[75] Inventors: Hal C. Shook, Kensington, Ga.; Carmon D. Holland, Laurel, Miss.; Ray J. Bridges, East Ridge, Tenn.

[73] Assignee: Landes Company Inc.

[21] Appl. No.: 417,744

[22] Filed: Oct. 5, 1989

[51] Int. Cl.[5] ..... E01D 21/02

[52] U.S. Cl. ..... 249/211; 249/23; 249/219.1; 254/13; 254/98

[58] Field of Search ..... 249/19, 23, 24, 25, 249/207, 210, 211, 219.1; 254/13, 98, 102

[56] References Cited

U.S. PATENT DOCUMENTS

| | | | |
|---|---|---|---|
| 2,739,788 | 3/1956 | Weaver | 254/102 |
| 3,162,922 | 12/1964 | Alziari | 254/98 |
| 3,797,800 | 3/1974 | Loy | 254/13 |
| 4,227,672 | 10/1980 | Cunningham | 249/24 |
| 4,231,977 | 11/1980 | Schreck et al. | 249/25 |
| 4,553,729 | 11/1985 | Connors | 249/219.1 |
| 4,905,387 | 3/1990 | Street | 254/102 |

*Primary Examiner*—James C. Housel

[57] ABSTRACT

A concrete supporting bridge overhang bracket system which can be lifted and transferred in gang fashion from a first section of a bridge after it has been formed to a subsequent section. The system includes a series of longitudinally spaced apart laterally extending overhang brackets to which concrete forms are secured. A lift bracket assembly is attachable to a pair of overhang brackets and can be clamped to the deck to support the overhang brackets and the forms from the deck so that the brackets can be disconnected from the deck. Once disassembled, the lift bracket assembly can be supported by a crane and unclamped from the deck, the crane thereafter moving the lift bracket assembly, the overhang brackets and the forms to the subsequent section. Also disclosed is a pivotably adjustable edge form which permits the outer edge of the deck to be vertically inclined irrespective of the horizontal inclination of the deck. Also disclosed is a sleeve member disposed about the hange rod of each overhang bracket so that after the deck is poured the rod can be disconnected from the form supporting overhang bracket from the surface of the deck.

10 Claims, 2 Drawing Sheets

CONCRETE POURING FORM SYSTEM FOR BRIDGE OVERHANG DECKS

BACKGROUND OF THE INVENTION

This invention relates to the construction of a bridge overhang deck and more particularly to an adjustable and readily transferable concrete form support system for supporting the forms used in the pouring of concrete bridge overhang decks.

In the construction of bridges concrete is poured in wet form onto molds or forms. The sides of the bridges normally have an overhang extending in overhanging fashion to one side of a supporting beam. The overhang is a cantilevered extension of the roadbed beyond the support member. Due to the changes in super-elevation or bank about curves on the bridge, such as a curved ramp or the like, it is important that the proper super-elevation be maintained at the various points when the concrete roadbed is poured. Each section of the bridge overhang deck to be poured is supported by a number of spaced apart overhang support brackets, and after a poured section has cured, the brackets in the prior art are disassembled, moved to a subsequent section to be poured, and reassembled. Additionally, to disassemble the prior art brackets requires the excessive use of a crane to hold each form while the brackets are disassembled, the crane being utilized to support a heavy C-frame assembly known in the art as a "C-caddy" hold the brackets while a man unloosens a hanger bolt from beneath the bracket. The crane carrying the bracket is thereafter moved to the subsequent section. Crane fees are a major cost factor in the construction of such bridges, and the crane when utilized for the aforesaid purposes must be taken from another portion of the construction and is not utilized in an effective and efficient manner. Various overhang concrete pouring support brackets have been proposed in the prior art such as, for example, those disclosed in U.S. Pat. Nos. 3,584,825 (Williams); 3,782,675 (Boll et al); 3,782,676 (Boll et al); 3,806,074 (Ward); 3,861,634 (Hood et al); and 4,450,121 (Bequette).

Additionally, in the construction of such bridge overhangs as the contour of the edge of the bridge varies, different edge forms taking into account the different inclinations of the edge must be utilized, thereby requiring a substantial number of edge forms to be assembled and disassembled from the bridge overhang support brackets. The lack of adjustability of the edge forms adds to increased labor costs, and inefficient utilization of manpower and an increase in the time required to assemble the forms at the subsequent sections.

The construction of a major bridge can be quite costly and time consuming. Any improvements directed toward the reduction in the time to assemble, transfer and reassemble the concrete forms utilized for the bridge overhang, and the more effective utilization of the cranes required, not only can result in reducing the construction time and costs for the overhang portion of the bridge, but can also reduce the overall time for completing the bridge.

SUMMARY OF THE INVENTION

Consequently, it is a primary object of the present invention to provide a concrete pouring form system for constructing bridge overhang decks which reduce the time to disassemble, transfer and reinstall the concrete pouring support brackets used for supporting the forms together with the forms.

It is another object of the present invention to provide a lift bracket assembly used in conjunction with bridge overhang support brackets which permits a gang of overhang support brackets and pouring forms to be lifted as a unit for transfer after use from a first section of the bridge to a subsequent section of the bridge for use in pouring concrete at the subsequent section.

It is a further object of the present invention to provide a bridge overhang concrete form which has an edge form that is adjustable to change the inclination of the edge relative to the deck thereby to accommodate variations in the contour of the edge of the bridge and for accommodating the contour of other bridges.

It is a still further object of the present invention to provide a concrete form construction which permits disassembly of the overhang bracket hanger rod from the bracket and the poured concrete manually from the surface of the concrete above the bracket.

Accordingly, one aspect of the present invention provides a concrete supporting bridge overhang bracket system which can be lifted and transferred in gang fashion from a first section of a bridge to a subsequent section without the use of a C-caddy, the system including a lift bracket assembly that is attachable to overhang bracket members at longitudinally spaced locations at the first section while supported on the poured concrete surface at the first section. The lift bracket assembly when positioned supports the overhang brackets at the first section and the overhang brackets and forms may then be disassembled from the concrete that has been poured and initially cured, thereby alleviating the need for a crane to support the overhang brackets during this procedure. Additionally, the lift bracket assembly can then be lifted with the overhang brackets and forms attached thereto and transferred to the subsequent section.

Each lift bracket comprises an upstanding beam selectively attachable at one end to a cooperating standard carried by and attachable to a respective overhang bracket and secured to an elongated beam assembly, the beam assembly carrying at least one and preferably two clamps adjustably movable relatively thereto for engaging the surface of the concrete at the first section. By adjustably positioning the clamps on the concrete surface, the overhang bracket may be tightly clamped to the concrete overhang deck so that the overhang bracket can be disconnected from the concrete without the need for a crane to support the overhang bracket. By using an assembly of two lift brackets, one adjacent each end of a section, all the overhang brackets at the section can be disconnected from the concrete at that section. Thereafter the crane may be utilized to support the entire assembly of lift brackets or overhang brackets and forms while the lift brackets are unclamped from the surface of the section, and the crane can move the entire assembly to a subsequent section for use.

In accordance with another aspect of the invention the edge form is pivotably adjustable relative to the deck form so that only one edge form is required, it being adjustable to accommodate the change in super-elevation or bank at the subsequent sections.

Another aspect of the present invention is the provision of a hanger having a hollow cylindrical sleeve member through which the hanger rod extends through the newly poured concrete so that the hanger rod may be removed from the top of the overhang bracket without the need for a person to disassemble the attachment from beneath the bracket.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
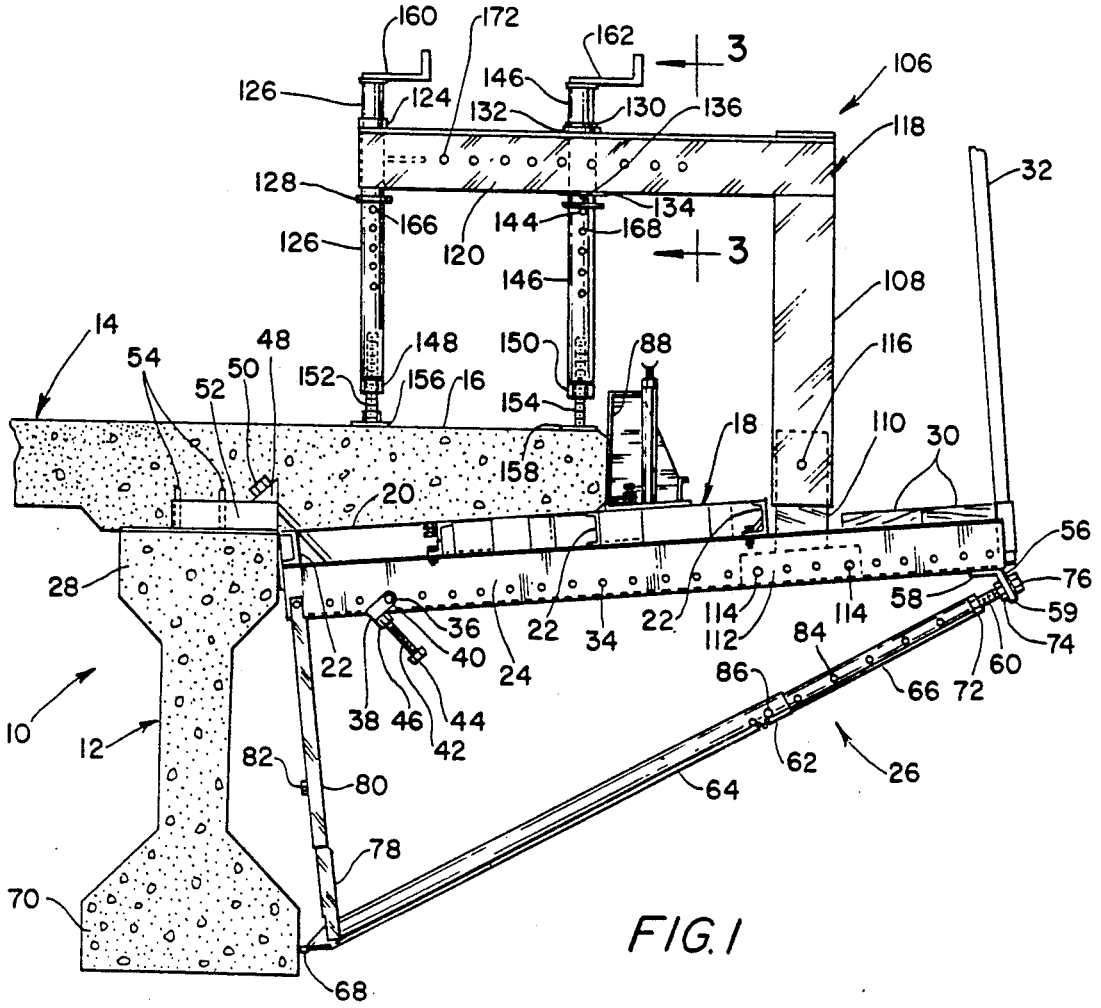
FIG. 1 is a cross sectional view taken substantially through an overhang portion of a bridge illustrating an overhang bracket having a lift bracket attached thereto together with other apparatus constructed in accordance with the principles of the present invention.

Referring now to the drawings, and particularly FIG. 1 a portion of a bridge structure is illustrated generally at 10 and includes a series of spaced apart bridge support concrete I-beams, only the laterally outer row of such beams 12 on one side of the bridge structure being illustrated. The beams 12 support the outer portion of the concrete roadbed 14 including the bridge overhang deck 16. A pouring form 18 comprising a steel skin 20 bolted to or otherwise secured to a plurality of channel members 22 which in turn are bolted to or otherwise secured to a U-shaped channel beam 24 forms a first leg of the overhang support bracket 26, the corner edge of the inner end of the pouring form 18 abutting the flange 28 of the I-beam 12. Walkboards 30 and guard rails 32 are carried by the U-shaped channel beam 24.

The beam 24 includes a plurality of holes 34 for receiving a bolt 36 which extends through a hanger bracket 38 which is thereby pivotably fastened to the beam 24. The hanger bracket 38 includes a plate or face 40 through which a rod 42 extends, the rod being threaded at least at its lower portion and at its upper end and having a bolt head 44 at its lower end. The rod 42 is secured against the face 40 by a nut 46, while at its upper end the rod 42 passes through a 45° hanger 48 and is secured thereto by means of another nut 50. The hanger 48 may include a horizontally extending portion 52 which rests upon the top of the flange 28 of the I-beam 12 and includes bores for receiving securing rods 54 to secure the beam 24 to the I-beam. Thus, the concrete poured in the overhang which tends to rotate the structure in a clockwise direction as viewed in FIG. 1 is counteracted by the structure comprising the 45° hanger 48, the portion 52 and the rods 54. For those bridges having steel I-beams rather than the concrete beam 12, a slightly different structure may be used as is known in the art.

At the end of the channel beam 24 remote from the I-beam 12 a substantially rectangular shaped connecting bracket 56 is welded along one leg 58 to the external surface of the trough of the beam 24, the width of the leg 58 being substantially equal to the width of the trough of the beam 24 between its legs. The other leg 59 of the bracket member 56 includes a hole for receiving a threaded rod 60 which is connected to an adjustable support beam generally indicated at 62 which comprises a first tubular member 64 telescopically receiving a second tubular member 66 which is adjustably secured thereto. Attached to the tubular member 64 crosswise substantially normal to the axis of the tubular members 64, 66 at the end remote from the member 66 is an abutment member in the form of a cylindrical rod or pipe 68. The tube 68 abuts the I-beam 12, preferably at the bottom flange 70. A receptacle member 72 having an internally threaded bore is secured to the end of the member 66 remote from the member 64, the member 72 preferably being a nut welded to the end of the member 66. Threadily received within the nut 72 is the threaded rod 60 having thereon a stop member 74 preferably formed from another nut spaced from the free end thereof. The free end of the rod 60 passes through the leg 58 of the bracket 56 and has a hex nut 76 or other such element secured thereon which may be rotated by a wrench or the like.

Pivotably fastened to the tubular member 64 spaced from the rod 68 is a first U-shaped beam 78 which is telescopically received within a second U-shaped beam 80 which is pivotably fastened to the channel beam 24, and first and second beams 78, 80 being adjustably connected by a bolt 82. The member 64, at least at the end remote from the cross member 68, includes a plurality of longitudinally spaced radial holes 84, while the member 64 at the cooperating end includes at least one such hole adapted to be aligned with the holes 84 so that at least one bolt may extend through a pair of selected aligned holes and be secured by a nut 86 or the like at the selected length for providing a coarse adjustability of the inclination of the channel beam 24 relative to the vertical axis. Fine adjustment is provided to the channel beam 24 and thus the pouring form 18 by rotation of the nut 76 thereby threadily adjusting the rod 60 into and out of the receptacle 72. Rotation of the nut 76 pivots the channel beam 24 about the end of the form 18 which abuts the flange 28 of the I-beam 12 to change the inclination of the pouring forms. When the beam 24 is properly adjusted to the desired inclination the rod 42 is adjusted to maintain the beam 24 and the form 18 at that inclination while the concrete is poured.

Figure 2:
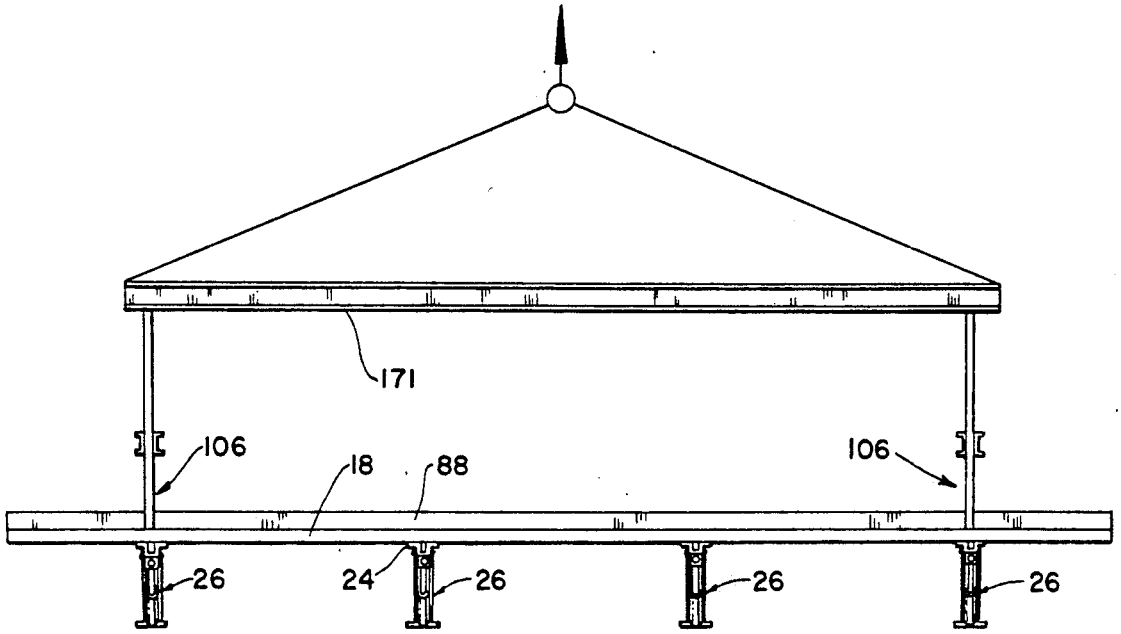
FIG. 2 is a side elevational view of the apparatus illustrated in FIG. 1 with portions removed for clarity of presentation.

As illustrated in FIG. 2, overhang support brackets substantially identical to the overhang support bracket 26 are disposed at spaced dispositions relative to the bracket 26 and to each other over a longitudinal section of the bridge overhang to be poured, and the form 18 extends longitudinally and is supported by the series of brackets. For example, typically these brackets may be spaced 7 feet apart in a 28 foot section, the forms extending longitudinally 3½ feet beyond the distal brackets. The section of the bridge overhang deck may thus be poured on the forms and supported by all of the overhang brackets at the section. Because the forms 18 are bolted to the overhang brackets 26, the entire section of brackets and forms may be lifted as a gang and moved to a subsequent section of the bridge after the concrete has been poured and set.

Figure 4:
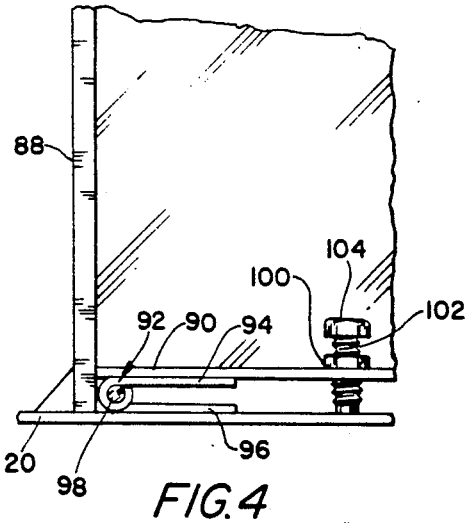
FIG. 4 is a fragmentary view of a portion of the edge form illustrated in FIG. 1 greatly enlarged for purposes of presentation.

To support the outer edge of the overhang deck 16 it has been conventional to utilize edge forms having selected inclinations relative to the inclination of the beam 24 and thus the form 18, so that the edge of the deck is formed vertically despite the curvature of the deck, e.g., where the overhang is a curved ramp. As aforesaid, this creates an excessive number of forms and inefficiency in assembling and disassembling the required form. In accordance with one aspect of the present invention an adjustable edge form 88 is utilized. As best illustrated in FIG. 4 the edge form 88 is an upstanding longitudinal wall and has a laterally extending leg 90, the leg extending outwardly relatively to the roadbed. A butt hinge 92 having a pair of interconnected plates 94, 96 pivotable about a pin 98 has one of the plates, e.g., plate 94, secured to the leg 90 and the other plate, e.g., plate 96, secured to the skin 20 of the form 18. A plurality of longitudinally spaced apart nuts 100, only one of which being illustrated, is secured as by welding to the leg 90 for threadily receiving the shank 102 of a respective bolt. As the head 104 of the bolt is rotated manually, the vertical inclination of the edge form 88 may be selectively adjusted to be vertical irrespective of the inclination of the form 18, thereby overcoming the necessity of utilizing a plurality of edge forms which must be disconnected from the deck form.

Once the concrete has been poured and set so that the forms 18 may be removed to a subsequent station of the bridge, the overhang brackets 26 must be disconnected from the formed section. In the prior art this is performed by transporting a crane to the formed section for holding supporting all of the brackets and forms by means of a spreader bar and C-caddy or the like while a workman climbs beneath the brackets to rotate the bolt head 44 to strip or unthread the rod 42 from the nut 50. The nut 50 remains in the concrete and the rod 42 is withdrawn so that the brackets 26 and the forms 18 can be disconnected from the poured concrete overhang section. As aforesaid, this procedure requires the removal of the crane from another function thereby extending the time to construct the bridge and when one considers the number of times that the crane must be moved from section to section and the amount of inefficient transfer time involved, and the fact that the construction may require the use of additional cranes for the construction of the bridge, the inefficiency of the prior art procedure is clear.

Figure 3:
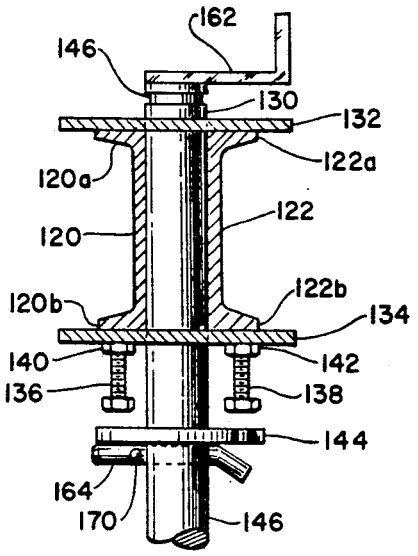
FIG. 3 is a cross sectional view taken substantially along line 3—3 of FIG. 1.

In accordance with an important aspect of the present invention a lift bracket assembly comprising a pair of lift brackets 106 is proposed, the lift brackets being attachable to spaced apart overhang brackets 26 as illustrated in FIG. 2. As illustrated in FIGS. 1 and 3 each lift bracket 106 comprises an upstanding tube 108 which is hollow at least at its lower end, and in the preferred embodiment has a rectangular configuration and is hollow throughout its length. The lower end of the tube 108 is adapted to receive within the hollow an upstanding standard 110 of substantially the same configuration as the tube but slightly smaller in cross section so as to be received within the tube, the standard 110 being secured to a laterally elongated base member mounted in the interior of the U-shaped channel beam 24 beneath the legs thereof and attached thereto by pins or bolts 114 extending through at least two of the bores 34 and corresponding aligned bores in the base member 112. A pin 116 removably connects the tube 108 to the standard 110 for purposes hereinafter made clear, the pin permitting connection and permitting slight relative movement between the tube 108 and the standard 110.

Secured as by welding to the upper end of the tube 108 so as to form an L-shaped assembly therewith is an elongated beam assembly 118 which, as best illustrated in FIG. 3, comprises a pair of U-shaped channel beams 120, 122 having their respective legs or flanges 120*a*, 120*b* and 122*a*, 122*b* respectively extending outwardly from each other and with their respective webs disposed vertically and adjacent to but spaced from each other. At the end remote from the tube 108 the webs of the beams 120, 122 are secured as by welding to a hollow cylindrical sleeve 124 within which a hollow pipe 126 is disposed, the pipe extending through an annular disk 128 secured as by welding to the lower end of the sleeve 124. Disposed intermediate the sleeve 124 and the tube 108 is another sleeve 130 which sleeve is welded or otherwise secured to a pair of vertically spaced apart plates 132, 134 through which the sleeves extend. The upper plate 132 is disposed on the upper surface of the legs or flanges 120*a*, 122*a* of the beams 120, 122, while the lower plate 134 may be clamped to the lower surfaces of the legs or flanges 120*b*, 122*b* of the beams 120, 122 by means of clamping bolts 136, 138 which are threadily received within nuts 140, 142 welded to a lower surface of the plate 134 so that the sleeve 130 may be adjustably positioned relative to the beams 120, 122 in its longitudinal direction. An annular disk 144 similar to the disk 128 is secured as by welding to the lower end of the sleeve 130 and a pipe 146 is receivable through the sleeve and the disk 130, 144 respectively.

Secured in the bottom end of each of the pipes 126 and 146 is a respective nut 148, 150 or other internally threaded member which threadily receives a respective threaded rod 152, 154 having a respective foot 156, 158 at the free end thereof. At the top end of each pipe 126, 146 a respective crank member 160, 162 is secured, each crank being adapted for manual engagement so as to rotate the pipes 126, 146 selectively. A respective pin 164 (only one of which is illustrated) associated with each pipe 126, 146 is selectively positioned within one of a plurality of bores 166, 168 in the respective pipe 126, 146 so as to provide an abutment stop against which the respective annular disk 128, 144 engages as the cranks rotates the pipes. Each pin may have a spring biased ball detent 170 to provide a friction lock for the pin.

Thus, after a section of the overhang has been poured and set a lift bracket 106 is connected to at least the longitudinally remote overhang brackets 26 by disposing the standard 110 within the tube 108 and inserting the pin 116 into the aligned holes so as to connect the tube and standard together. The pipe 126 is slidably dropped downwardly through the sleeve 124 so that the foot 156 engages the surface of the overhang deck 16 and a pin 164 is inserted through a hole 166 adjacent the disk 128. The sleeve 130 is thereafter positioned so that the foot 158 will also engage the surface of the overhang deck 16. This is performed by first positioning the sleeve together with the plates 132, 134 relative to the beams 120, 122 and tightening the clamping bolts 136, 138, and thereafter slidably dropping the pipe 146 downwardly within the sleeve 130 so that the foot 158 engages the deck 16. A pin 164 is thereafter inserted through a hole 168 adjacent the disk 144. Rotation of the cranks 160, 162 may thereafter be performed to rotate the pipes 126, 146 relative to the respective rod 152, 154 until they are clamped tightly between the deck 16 and the disks 128, 144. A workman may then climb beneath the deck and unthread the rod 42 of each overhang bracket from the respective nut 50 to disconnect the overhang brackets 26 from the concrete without the need to use the crane while the overhang brackets are disassembled. One or more spreader bars, e.g., bar 171 or similar spanning members may then be connected to selective holes 172 in beams 120, 122 of each lift bracket and the entire assembly may thereafter be removed by a crane to a subsequent section. However, prior to lifting the lift brackets, the cranks 160, 162 are first loosened and the pins 146 are retracted from a first of the clamping pipes 126, 146 so that the pipe together with the respective rod 152, 154 may be raised relative to its sleeve. After the pipe has been raised, the pin 146 is inserted into a hole 166, 168 in the respective pipe above the beams 120, 122. The same procedure is formed for the other pipe assembly so that the pipes, threaded rod and feet are conveniently out of the way when the lift bracket assembly is raised by the crane.

Figure 5:
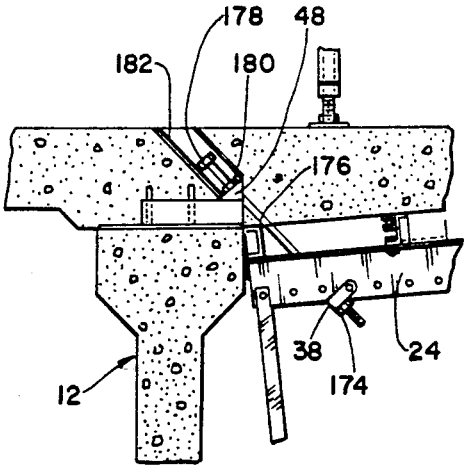
FIG. 5 is a cross sectional view of a portion of the bridge overhang system illustrated in FIG. 1 depicting a modification thereof in accordance with another aspect of the present invention.

In accordance with another feature of the present invention, to alleviate the need for a workman to climb beneath the overhang in order to disconnect the hanger rod 42, structure is proposed which permits this operation to be performed from the upper surface of the deck 16. As illustrated in FIG. 5, a nut 174 is welded or otherwise permanently secured to the hanger bracket 38 and the configuration of the hanger rod is modified so that it has a bolt head 178 at its upper end spaced from a stop nut 180, the stop nut 180 engaging the conventional hanger bracket 48. After the hanger rod 176 is connected to the hanger bracket 48, a cylindrical sleeve 182 is disposed about the rod at its upper end so that the bolt head 178 and stop nut are within the sleeve 182 and the lower end of the sleeve abuts the 45° surface of the bracket 48. The length of the sleeve 182 should be at least such that it will be entirely at or above the surface of the concrete after it has been poured. After the concrete has been poured and set, a workman can remove the rod 176 from the surface of the deck merely by turning the head 178 which is readily accessible through the sleeve 182. The sleeve is thereafter removed and the void formed thereby can then be filled with concrete as required. When used together with the lift bracket assemblies 106, this structure provides a rapid means of disconnecting the overhang brackets and permits the removal of the forms from the first section for use at a subsequent section.

Accordingly, the present invention provides a concrete pouring form system for use in constructing bridge overhang decks which reduces the time to disassemble, transfer and reinstall the concrete pouring support brackets and forms, the brackets and forms being transferred as a gang from a formed section for use at a subsequent section. The structure thus provides a substantially greater efficiency in the construction of the overhang sections of a bridge reducing the amount of crane time required and the cost associated therewith, together with the overall time and costs required for constructing the bridge overhang portions.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Apparatus for securing together a concrete deck after the concrete deck has been formed and an assembly of at least one overhang support bracket and concrete pouring forms supported thereon so that the forms and support bracket may be disconnected from the deck, the deck being supported on and overhanging an upright support column, said overhang support bracket including an elongated beam having an upper surface carrying said forms, said beam extending from a first end adjacent said column to a second end disposed outwardly beyond said deck and said forms, at least a first leg connected to said second end of said beam, said leg abutting said support column beneath said beam, a hanger bracket fastened on said column, a rod connected to said hanger bracket and to said elongated beam for securing said beam to said column, said apparatus comprising a base member fastened to said beam outwardly of said deck and said forms, said base having an upstanding standard, a substantially L-shaped assembly comprising an upright member and laterally extending beam means secured to the top of said upright member, connecting means for removably fastening said upright member to said standard such that said beam means extends inwardly and at least a portion of said beam means overlays said deck, and clamping means carried by said beam means and adjustably movable vertically relatively thereto for engaging said deck and applying a force between said deck and said beam means to clamp said deck between said forms and said beam means, whereby said rod may be disconnected from said hanger bracket and removed from said elongated beam, said clamping means comprises at least one sleeve secured to and extending beneath said beam means, a clamp rod received through said sleeve, a clamping foot threadily carried at the lower end of said clamp rod for engaging said deck and for movement relative to said clamp rod, adjustable stop means permitting rotational movement of said clamp rod relative to said sleeve while precluding movement of said clamp rod upwardly relative to said sleeve, said adjustable stop means being vertically adjustable relative to the clamp rod, and means for rotating said clamp rod to threadily move said foot vertically relative to said clamp rod and to said beam means.

2. Apparatus as recited in claim 1, wherein said beam means comprises a pair of C-shaped channel beams each including a web and a leg at each end of the web, said channel shaped beams being disposed with the web of one adjacent to and spaced from the web of the other and with the legs of each channel beam extending in a direction opposite to the legs of the other channel beam, said sleeve being intermediate and secured to the webs of both channel beams.

3. Apparatus as recited in claim 1, wherein said clamping means further includes a second sleeve adjustably secured to said beam means intermediate said upright member and said one sleeve, a second rod received through said second sleeve, a second foot threadily carried at the lower end of said second rod for engaging said deck and for movement relative to said second rod, adjustable stop means permitting rotational movement of said second rod relative to said second sleeve while precluding movement of said second rod upwardly relative to said second sleeve, and means for rotating said second rod to threadily move said second foot vertically relative to said second rod and to said beam means.

4. Apparatus as recited in claim 2, wherein said clamping means further includes a second sleeve adjustably secured to the webs of said channel beams intermediate said upright member and said one sleeve, a second rod received through said second sleeve, a second clamping foot threadily carried at the lower end of said second rod for engaging said deck and for movement relative to said second rod, adjustable stop means permitting rotational movement of said second rod relative to said second sleeve while precluding movement of said second rod upwardly relative to said second sleeve, and means for rotating said second rod to threadily move said foot vertically relative to said second rod and to said beam means.

5. Apparatus as recited in claim 1, wherein said forms are supported by and secured to a plurality of overhang support brackets spaced apart longitudinally of said deck.

6. Apparatus as recited in claim 5, wherein said forms comprise a longitudinally and laterally extending inclined surface on which concrete is poured for forming the vertical thickness of said deck, and a longitudinally and vertically extending wall for forming a vertical outer most edge of said deck, means for pivotably mounting said wall on said surface for changing the inclination of said wall relative to said surface so that said wall and thereby said edge may be disposed vertically irrespective of the horizontal inclination of said surface.

7. Apparatus as recited in claim 1, wherein said upright member and said standard are telescopically receivable one within the other, and said connecting means comprises a pin extending through said upright member and said standard.

8. Apparatus as recited in claim 1, wherein said beam comprises a substantially U-shaped channel member having a pair of upwardly extending legs, and said base member is fastened between the legs of said channel member.

9. Apparatus for securing together a concrete deck after the concrete deck has been formed and an assembly of at least one overhang support bracket and concrete pouring forms supported there on so that the forms and support bracket may be disconnected from the deck, the deck being supported on and overhanging an upright support column, said overhang support bracket including an elongated beam having an upper surface carrying said forms, said beam extending form a first end adjacent said column to a second end disposed outwardly beyond said deck and said forms, at least a first leg connected to said second end of said beam, said leg abutting said support column beneath said beam, a hanger bracket fastened on said column, a rod connected to said hanger bracket and to said elongated beam for securing said beam to said column, said apparatus comprising a base member fastened to said beam outwardly of said deck and said forms, said base having an upstanding standard, a substantially L-shaped assembly comprising an upright member and laterally extending beam means secured to the top of said upright member, connecting means for removably fastening and upright member to said standard such that said beam means extends inwardly and at least a portion of said beam means overlays said deck, and clamping means carried by said beam means and adjustably movable vertically relatively thereto for engaging said deck and applying a force between said deck and said beam means to clamp said deck between said forms and said beam means, whereby said rod may be disconnected from said hanger bracket and removed from said elongated beam, said clamping means comprises at least one sleeve secured to and extending beneath said beam means, a clamp rod received through said sleeve, a clamping foot threadily carried at the lower end of said clamp rod for engaging said deck and for movement relative to said clamp rod, adjustable stop means permitting rotational movement of said clamp rod relative to said sleeve while precluding movement of said clamp rod upwardly relative to said sleeve, said adjustable stop means being vertically adjustable relative to the clamp rod, and means for rotating said clamp rod to threadily move said foot vertically relative to said clamp rod and to said beam means, said clamping means further includes a second sleeve adjustably secured to said beam means intermediate said upright member and said one sleeve, a second rod received through said second sleeve, said second sleeve being horizontally adjustable relative to said beam means, a second foot threadily carried at the lower end of said second rod for engaging said deck and for movement relative to said second rod, adjustable stop means permitting rotational movement of said second rod relative to said second sleeve while precluding movement of said second rod upwardly relative to said second sleeve, and means for rotating said second rod to threadily move said second foot vertically relative to said second rod and to said beam means.

10. Apparatus for securing together a concrete deck after the concrete deck has been formed and an assembly of at least one overhang support bracket and concrete pouring forms supported thereon so that the forms and support bracket may be disconnected from the deck, the deck being supported on and overhanging an upright support column, said overhang support bracket including an elongated beam having an upper surface carrying said forms, said beam extending from a first end adjacent said column to a second end disposed outwardly beyond said deck and said forms, at least a first leg connected to said second end of said beam, said leg abutting said support column beneath said beam, a hanger bracket fastened on said column, a rod connected to said hanger bracket and to said elongated beam for securing said beam to said column, said apparatus comprising a base member fastened to said beam outwardly of said deck and said forms, said base having an upstanding standard, a substantially L-shaped assembly comprising an upright member and laterally extending beam means secured to the top of said upright member, connecting means for removably fastening said upright member to said standard such that said beam means extends inwardly and at least a portion of said beam means overlays said deck, and clamping means carried by said beam means and adjustably movable vertically relatively thereto for engaging said deck and applying a force between said deck and said beam means to clamp said deck between said forms and said beam means, whereby said rod maybe disconnected from said hanger bracket and removed from said elongated beam, said clamping means comprises at least one sleeve secured to and extending beneath said beam means, a clamp rod received through said sleeve, a clamping foot threadily carried at the lower end of said clamp rod for engaging said deck and for movement relative to said clamp rod, adjustable stop means permitting rotational movement of said clamp rod relative to said sleeve while precluding movement of said clamp rod upwardly relative to said sleeve, said adjustable stop means being vertically adjustable relative to the clamp rod, and means for rotating said clamp rod to threadily move said foot vertically relative to said clamp rod and to said beam means, said beam means comprises a pair of C-shaped channel beams each including a web and a leg at each end of the web, said channel shaped beams being disposed with the web of one adjacent to and spaced from the web of the other and with the legs of each channel beam extending in a direction opposite to the legs of the other channel beam, said sleeve being intermediate and secured to the webs of both channel beams, said clamping means further includes a second sleeve adjustably secured to the webs of said channel beams intermediate said upright member and said one sleeve, a second rod received through said second sleeve, said second sleeve being horizontally adjustable relative to said beam means, a second clamping foot threadily carried at the lower end of said second rod for engaging said deck and for movement relative to said second rod, adjustable stop means permitting rotational movement of said second rod relative to said second sleeve while precluding movement of said second rod upwardly relative to said second sleeve, and means for rotating said second rod to threadily move said foot vertically relative to said second rod and to said beam means.

* * * * *